US005505795A

United States Patent [19]

Tsai et al.

[11] Patent Number: 5,505,795

[45] Date of Patent: Apr. 9, 1996

[54] METHOD OF MANUFACTURING GOLF CLUB

[76] Inventors: Jeffrey C. H. Tsai, No. 83, Nan Wan Street, Nan Wan Li; Alexander Y. T. Lee, No. 157 Yung Ta Road, both of Yung Kang City, Taiwan

[21] Appl. No.: 114,935

[22] Filed: Sep. 2, 1993

[30] Foreign Application Priority Data

Jun. 10, 1993 [CN] China ..... 93107048.1

[51] Int. Cl.[6] ..... C22C 14/00; A63B 53/00

[52] U.S. Cl. ..... 148/527; 148/522; 148/528; 148/671; 228/131; 228/219; 273/78

[58] Field of Search ..... 148/527, 528, 148/522, 671; 273/78; 228/219, 131, 132, 248, 221

[56] References Cited

U.S. PATENT DOCUMENTS 4,921,405 5/1990 Wilson ..... 148/522
5,024,437 6/1991 Anderson ..... 273/78
5,112,415 5/1992 Mae ..... 148/421
5,244,517 9/1993 Kimura et al. ..... 148/421

*Primary Examiner*—Upendra Roy
*Attorney, Agent, or Firm*—Morton J. Rosenberg; David I. Klein

[57] ABSTRACT

A method of manufacturing golf club is to design the contour of a club head and a club shaft. Sheet metal forming for divided golf club head are formed by stretching the Titanium Alloy plate within the forming dies, then processed with stress relief. Assembly welding are processed in a vacuum chamber where inner-gas, argon, is filled therein to avoid any inpurity may occur on the product during manufacture. Temperatures for stress relief, solid solution and aging are controlled in various degree depending upon each different procedures in order to form a best quality in vacuum furnace where vacuum gauge is best under ten to the negative fourth power of TORR.

7 Claims, 11 Drawing Sheets

| CHARACTER / MATERIAL | DENSITY | STRENGTH | HARDNESS |
|---|---|---|---|
| 17-4 PH CAST | 7.8 | 78 | 38 |
| Ti-6Al-4V PLATE | 4.42 | 221 | 38 |
| Ti-6Al-4 CAST | 4.42 | 112 | 38 |

FIG.10

| ALLOY | Al | V | Ti |
|---|---|---|---|
| Ti-6Al-4V | 5.50-6.75% | 3.50-4.50% | REMAINS |

FIG.11

METHOD OF MANUFACTURING GOLF CLUB

BACKGROUND OF THE INVENTION

1. Field of the Invention

This invention relates to a manufacturing method for producing golf clubs. More particularly this invention provides a method of designing and analyzing golf clubs through computer software to enhance the integral strength, elasticity, and quality of the resulting golf clubs.

2. Prior Art

Playing golf is a popular and suitable sport for people of all ages both for its mild exercise and many countless benefits. In order to be a proficient golfer, a high quality golf club set is important and thus golfers are constantly searching for a high quality club set. Many prior art golf clubs are formed by a club head A, as shown in FIGS. 5A and 5B having an aperture A1 formed at a top portion, and a shaft B. The inside diameter of the aperture A1 of the club head A is larger than the outside diameter of the shaft B so as to receive the shaft B therein. The shaft B is inserted into the head A through the aperture A1 and glue C is applied into the clearance between the aperture A1 and the shaft B to hold the head A and the shaft B together.

However, there are disadvantages with such prior art systems. Some disadvantages are as follows: (1) Glue C deteriorates over time or when temperature changes occur which causes the shaft B and the head A to loosen; and, (2) Glue C when inserted into the clearance between the aperture A1 and the shaft B for adherence of the club head A and the shaft B changes the quality of the golf club and affects the striking of a golf ball.

In the inventor, in view of this, has invented the present invention which improves the previously mentioned disadvantages.

SUMMARY OF THE INVENTION

It is the primary object of the present invention to provide a method of manufacturing a golf club which produces a high structural strength, elasticity, and quality club.

It is another object of the present invention to provide a method of manufacturing a golf club head which reduces cost and increased production capabilities.

It is still another object of the present invention to provide a method of manufacturing golf clubs which adopts a welding technique to connect a golf club head and a shaft.

It is a further object of the present invention to provide a method of manufacturing golf clubs which eliminates any defect that may actually exist in the club set during manufacture.

These and other objects of the invention will become apparent to one skilled in the art upon reading and understanding the detailed description of the invention set forth in following paragraphs taken together with the drawings.

BRIEF DESCRIPTION OF THE DRAWINGS

FIG. 10 is a comparison chart of titanium allow plate and prior art material;

FIG. 11 is a Ti-6AL-4V composite chart; and,

DETAILED DESCRIPTION OF THE PREFERRED EMBODIMENT

Figure 1:
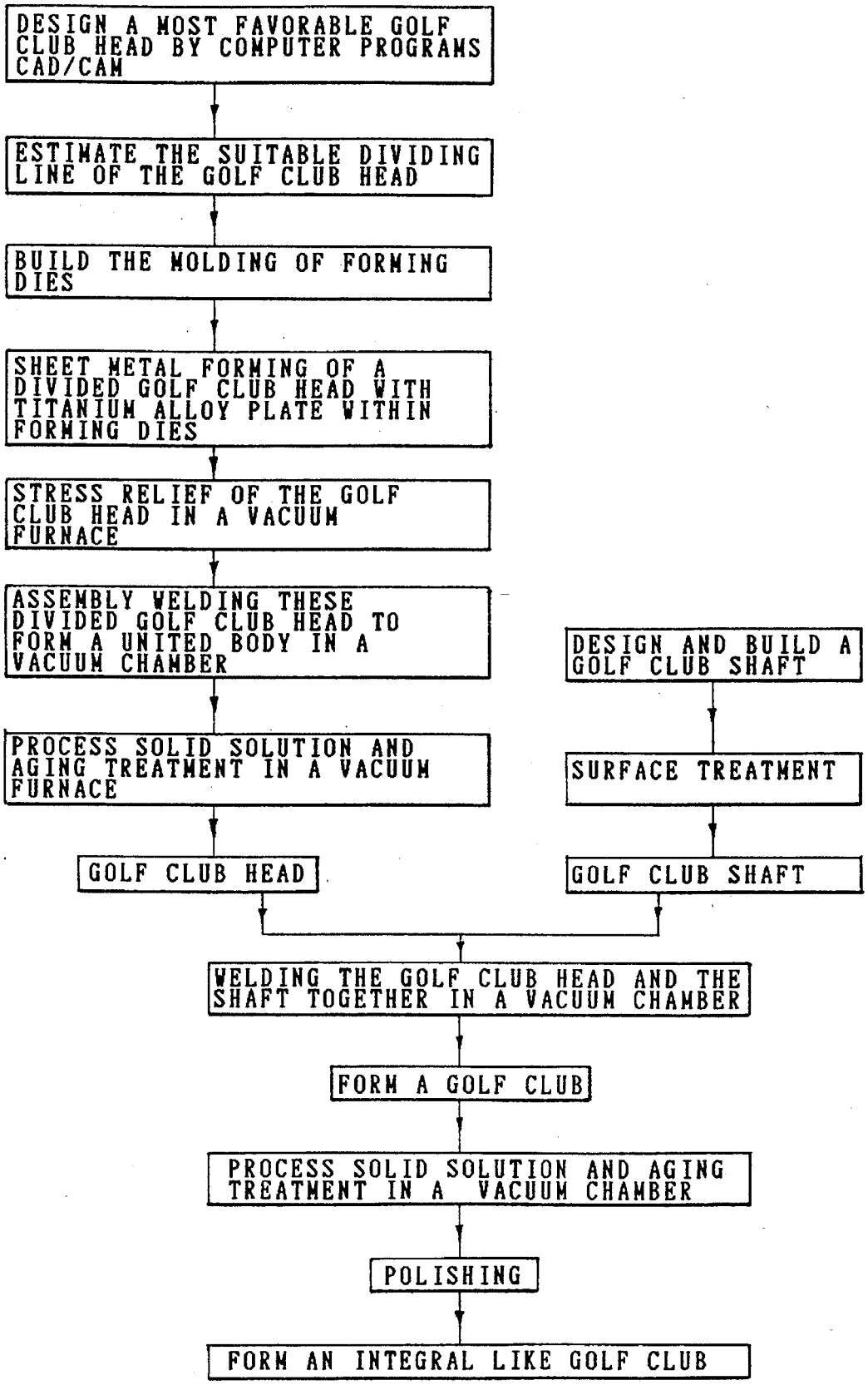
FIG. 1 is a flow chart of the method of manufacturing golf clubs, according to the present invention.
Figure 2A:
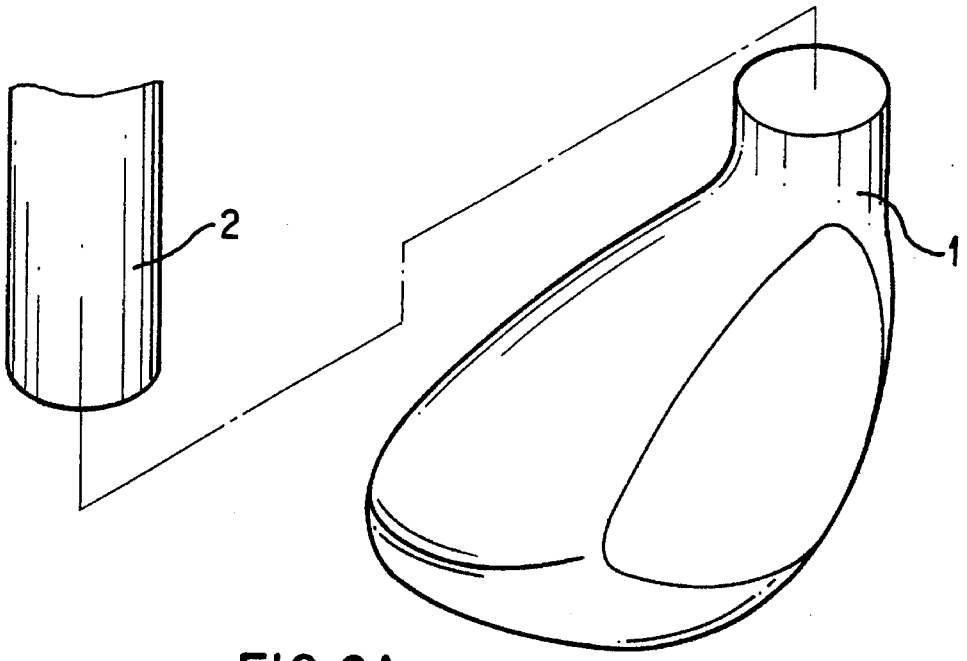
FIG. 2A is a fragmentary view of a club, according to the present invention.
Figure 2B:
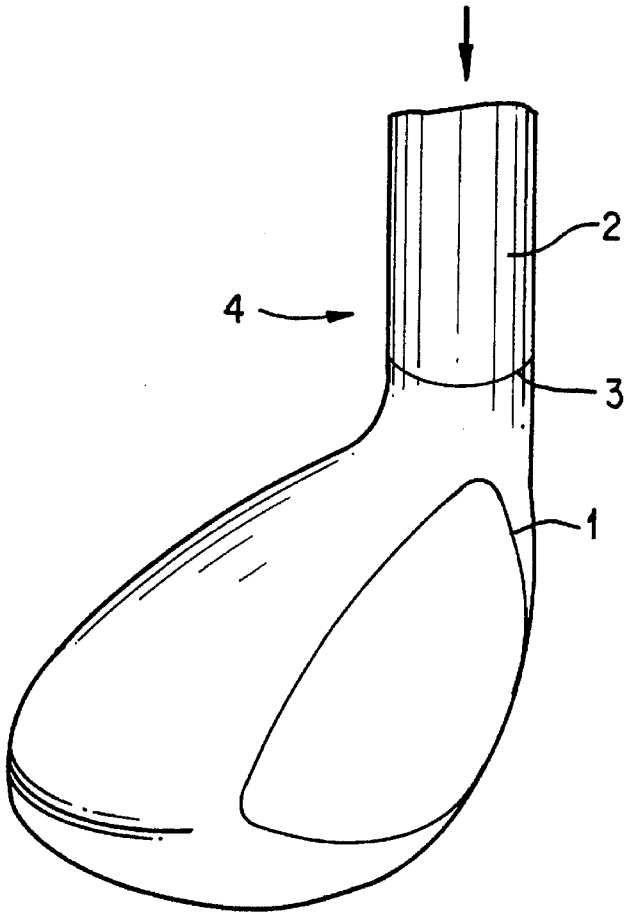
FIG. 2B is a perspective view of FIG. 2A.
Figure 3:
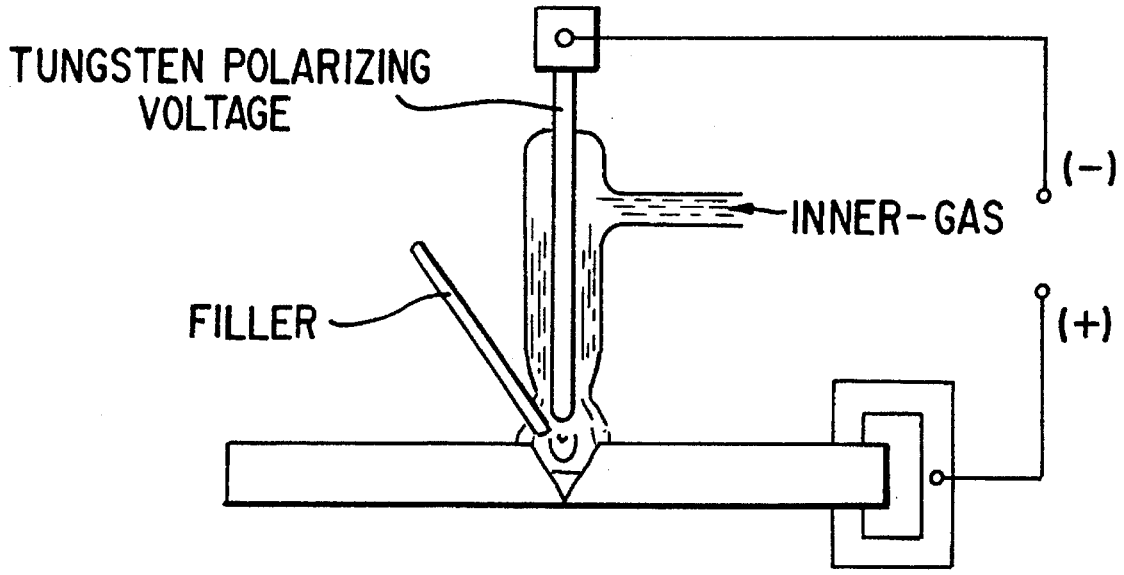
FIG. 3 is a drawing showing the welding method.
Figure 4:
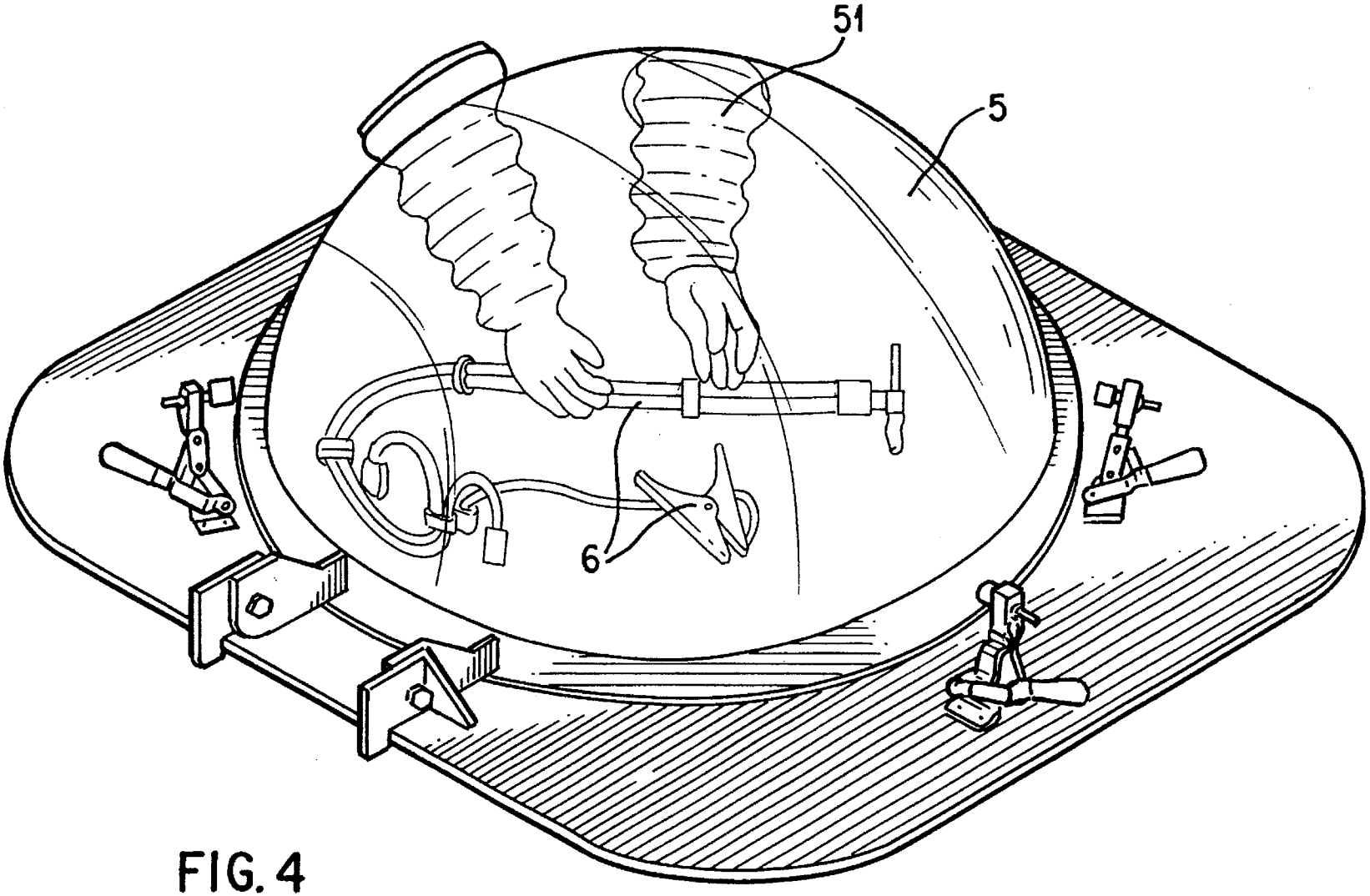
FIG. 4 is a drawing showing welding equipment within a vacuum chamber.
Figure 5A:
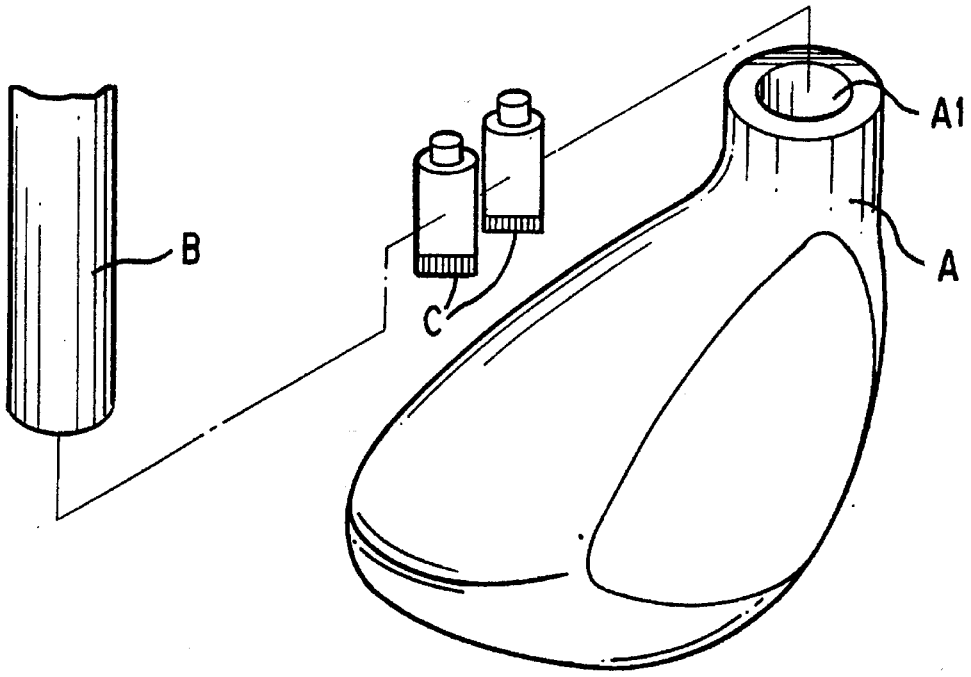
FIG. 5A PRIOR ART
FIG. 5A is a fragmentary view of a prior art golf club.
Figure 5B:
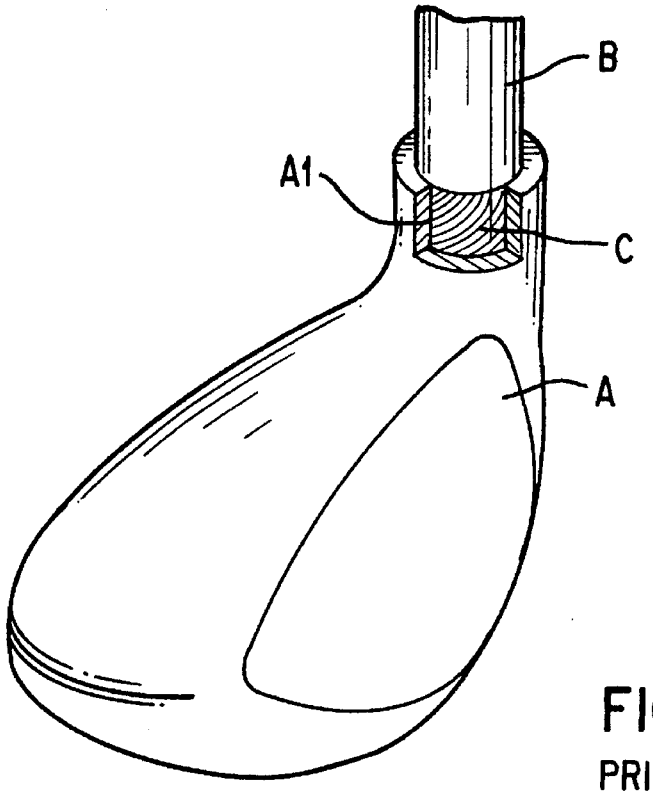
FIG. 5B PRIOR ART
FIG. 5B is a perspective view of FIG. 5A.
Figure 6:
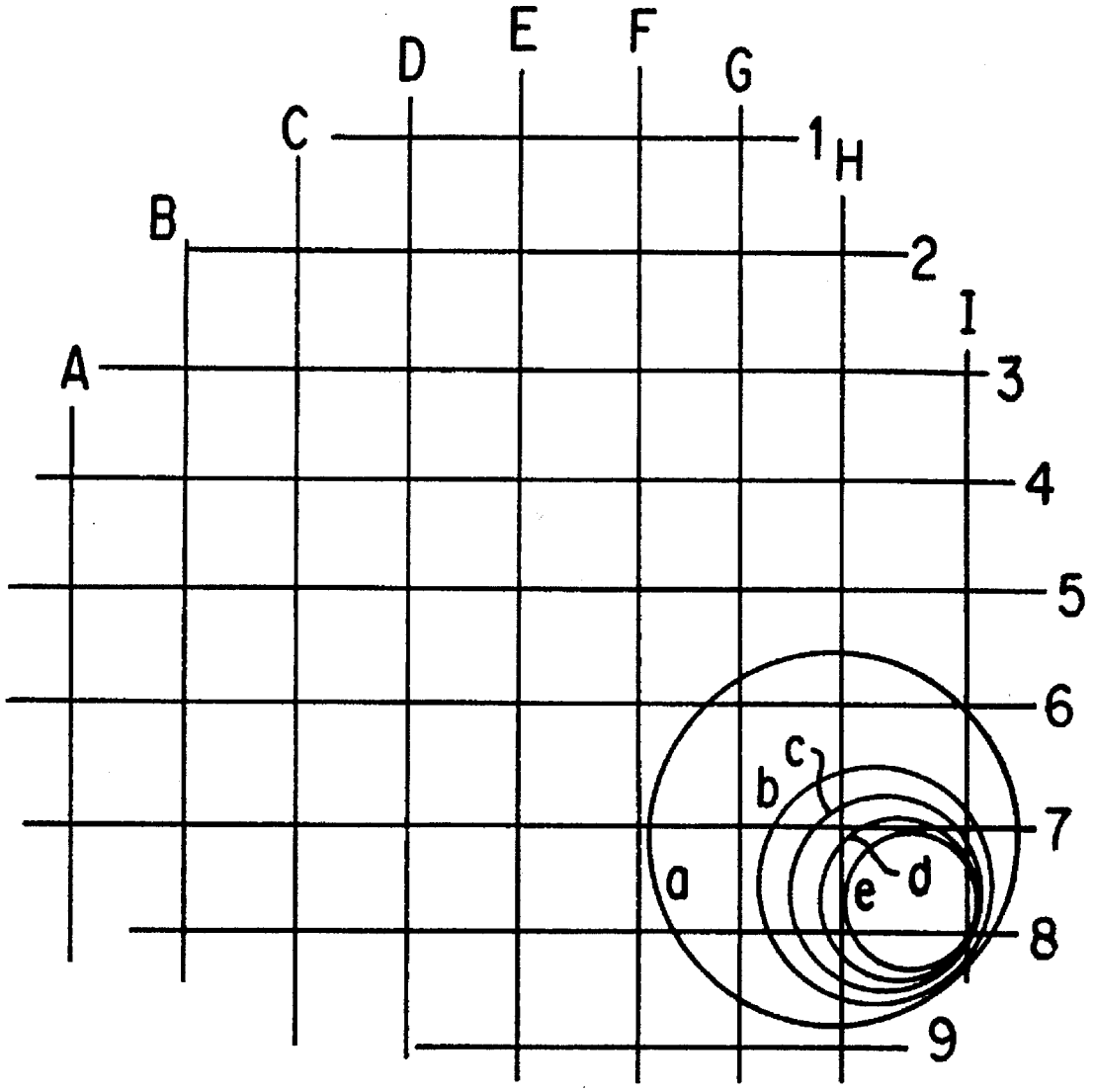
FIG. 6 is a graphical representation of a computer simulation of cartesian coordinates of the present invention.
Figure 7:
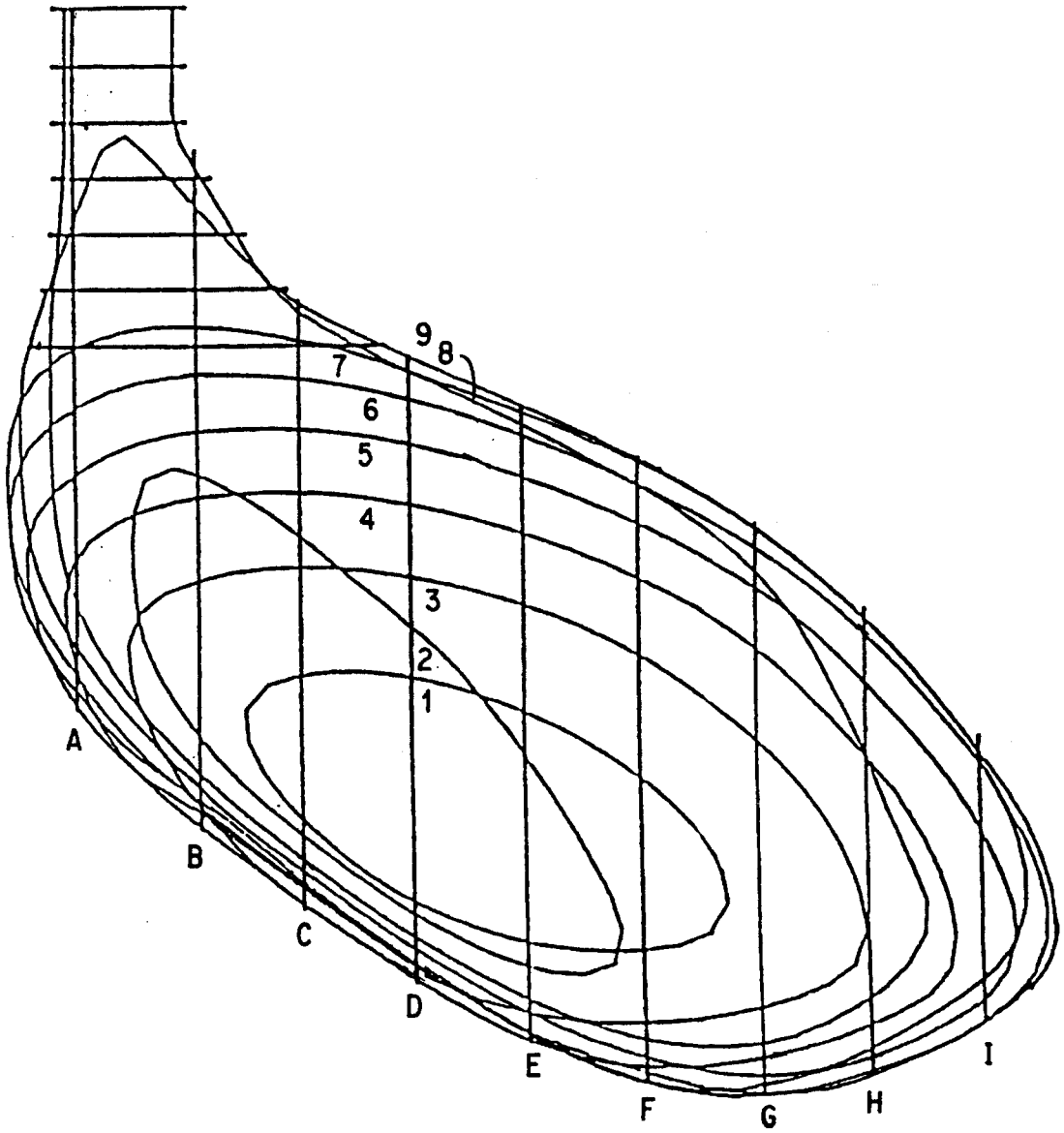
FIG. 7 is a graphical representation of computer simulation of a top view of a golf club head.
Figure 8:
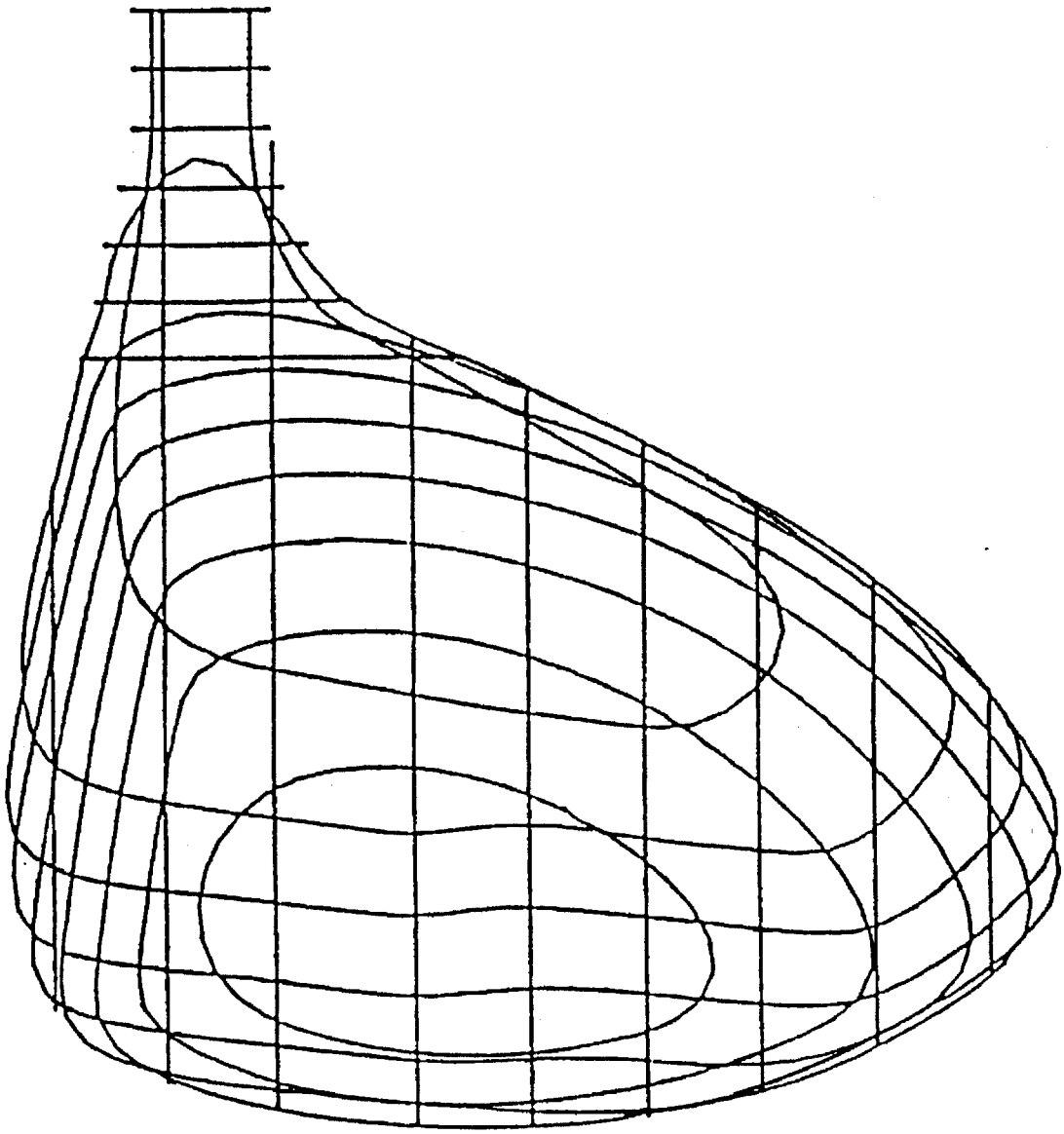
FIG. 8 is a graphical representation of a computer simulation of the front view of a golf club head.
Figure 9:
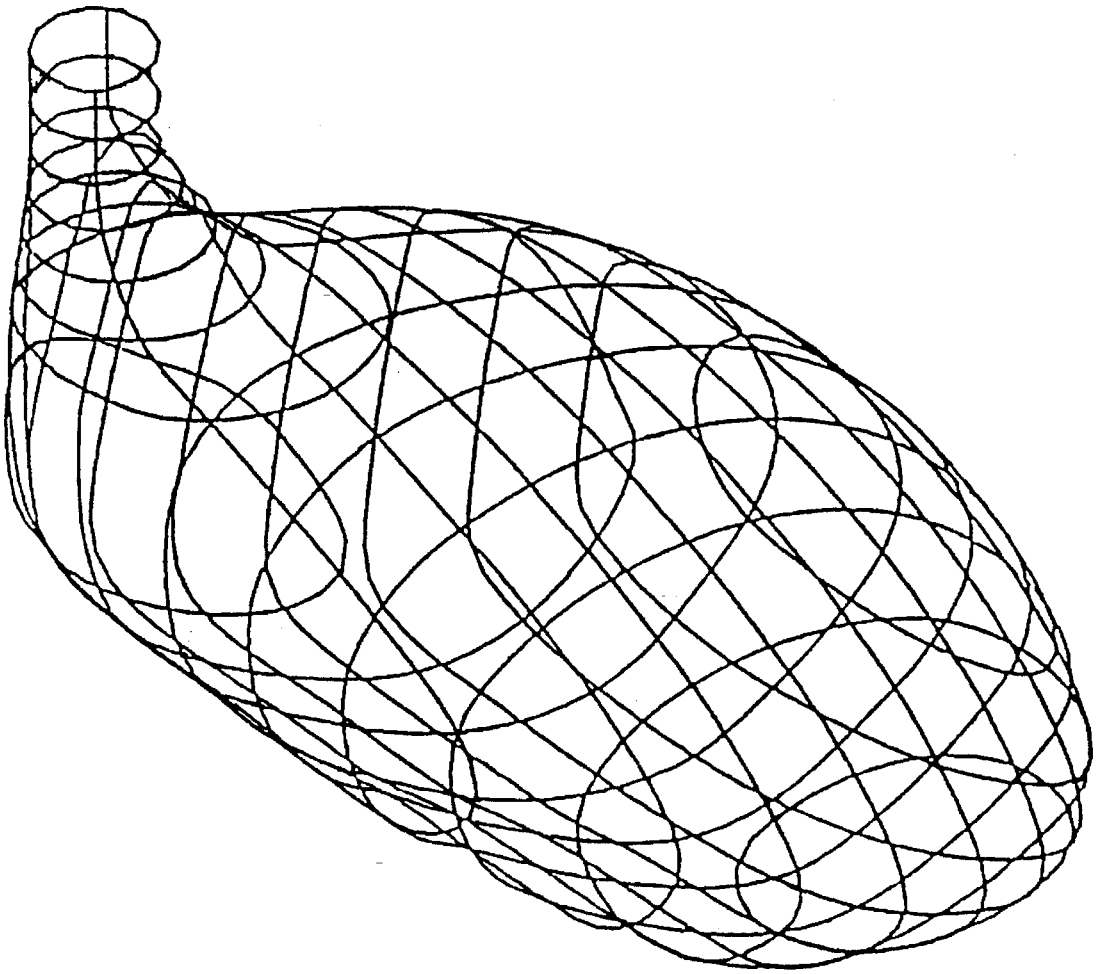
FIG. 9 is a graphical representation of a computer simulation of a golf club head.
Figure 12:
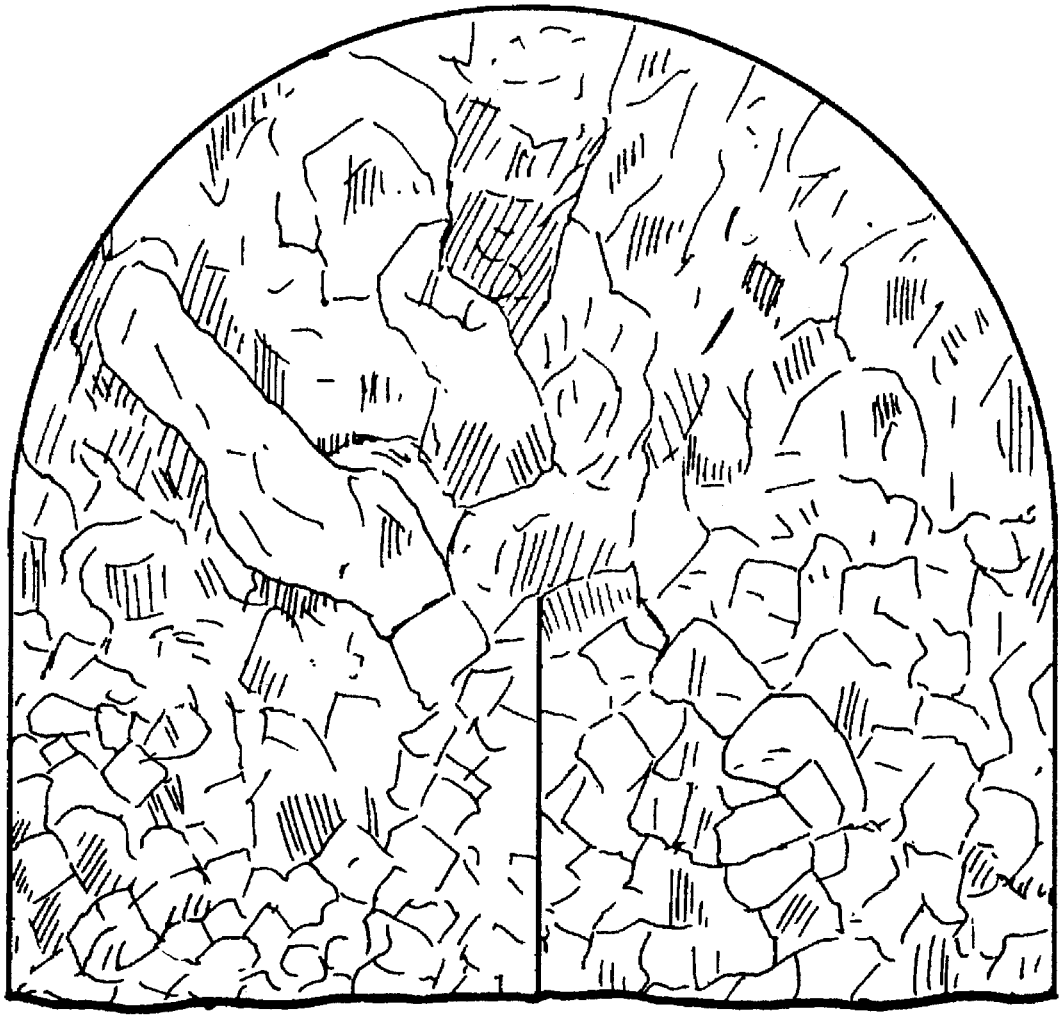
FIG. 12 is a photograph of metallurgical microstructure.

The method of producing golf clubs according to FIGS. 1, 2A and 2B is essentially composed of a plurality of steps including club head 1 forming, club shaft 2 forming, and club assembly welding. The first step, club head 1 forming, includes the steps of: (1) computer designing; (2) the molding of forming dies; (3) sheet metal forming; (4) stress relief; (5) assembly welding; (6) solid solution and aging treatment; and, (7) polishing.

The first step, as shown in FIG. 2, is to design a golf club head 1 using a computer program simulation, CAD/CAM, and to calculate the thickness, the size and the weight of the raw materials, which is composed of titanium alloy plate. This method step replaces the prior art trial and error method of design. The thickness of the plate as has been found according to the computer, is preferably between 1.0 mm to 3.5 mm.

The second step is to build sheet metal forming dies, which includes upper and lower dies according to the divided golf club head concept, through computer simulation. The titanium alloy plate is stretched within the forming dies, as the third step of the present invention.

Subsequently the formed parts are stress relieved within a vacuum furnace. The temperature for stress relief of the formed parts is preferably between 480 degrees to 815 degrees Centigrade which, according to evaluations, has been found to minimize impurity of the product during process. The stress relieved parts of the divided golf club head are assembly welded by a welding equipment 6 in vacuum chamber 5, to form an integral body with club head 1.

After the welding procedure, the club head 1 is processed with the final steps of solid solution, aging and polishing.

The temperature for the solid solution is preferably set between 790 degrees to 970 degrees Centigrade, while the temperature for aging treatment is preferably set between 480 degrees and 600 degrees Centigrade in an atmospheric pressure preferable under $10^{-4}$ Torr.

The procedure of manufacturing club shaft 2 is mainly by forming an intermediary semi-product requiring surface treatment before it becomes a final product.

In manufacture the head 1 and the shaft 2 are formed. Head 1 and shaft 2 are placed into the vacuum chamber 5 for welding to form a club 4, as shown in FIG. 2B. The club 4 is then processed with solid solution, aging and polishing to eliminate craters to form an optimized club 4.

As already noted, the temperature of each process of the above should remain the same as the temperature for processing the head 1. Although the welding is accomplished in a vacuum chamber to prevent resulting impurities, it is impossible to reach one hundred percent vacuum in the chamber, therefore, inert gas is used to fill the chamber for inert gas-arc welding. In order to receive a better welding result, inert gas such as argon, gathers at tungsten filament, and also surrounds the welding spot to isolate the area form air. The dew point of inert gas should not exceed minus 50 degrees Centigrade.

We claim:

1. A method of manufacturing golf clubs including the steps of:

designing said golf club head contour by a CAD/CAM computer program;

calculating the most appropriate dividing line of said golf club head for divided part; providing press forming dies of divided parts of said golf club head, forming the divided parts of golf club head by sheet metal of titanium alloy and stretching said sheet metal within forming dies;

assembling said divided parts of said golf club head welding said divided parts within a vacuum chamber to form a golf club head; and, welding said golf club head to a shaft to form a complete golf club.

2. A method of manufacturing golf club of claim 1, wherein said titanium alloy has a thickness preferably between 1.0 mm to 3.5 mm.

3. A method of manufacturing golf club of claim 1, including an inert gas inserted into said vacuum chamber wherein said inert gas is argon.

4. A method of manufacturing a golf club including the steps of:

(a) establishing a CAD/CAM computer simulation contour of said golf club having a golf club head and a shaft;

(b) further establishing dividing lines for defining divided portions of said golf club head;

(c) stretching titanium alloy sheet divided portions within sheet metal forming dies to a predetermined titanium alloy sheet thickness;

(d) assembling said divided portions of said golf club head into said computer simulation contour;

(e) initially vacuum welding said divided portions within a vacuum chamber to form said golf club head; and, (f) welding said golf club head to said shaft.

5. The method of manufacturing a golf club as recited in claim 4 where the step of stretching includes the step of forming said titanium alloy sheet to a preferable thickness within the range of 1.0 mm to 3.5 mm.

6. The method of manufacturing a golf club as recited in claim 4 where the step of vacuum welding includes the step of providing an inert gas within said vacuum chamber.

7. The method of manufacturing a golf club as recited in claim 6 where the inert gas is argon.

* * * * *